US007152687B2

(12) United States Patent
Gano

(10) Patent No.: US 7,152,687 B2
(45) Date of Patent: Dec. 26, 2006

(54) EXPANDABLE TUBULAR WITH PORT VALVE

(75) Inventor: John C. Gano, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 271 days.

(21) Appl. No.: 10/702,830

(22) Filed: Nov. 6, 2003

(65) Prior Publication Data

US 2005/0098324 A1 May 12, 2005

(51) Int. Cl.
*E21B 33/128* (2006.01)
*E21B 23/00* (2006.01)

(52) U.S. Cl. ..... 166/386; 166/206; 166/373

(58) Field of Classification Search ..... 166/386, 166/206, 373

See application file for complete search history.

(56) References Cited

U.S. PATENT DOCUMENTS

| | | | | |
|---|---|---|---|---|
| 3,785,193 | A | 1/1974 | Kinley et al. | 72/393 |
| 4,201,364 | A * | 5/1980 | Taylor | 251/175 |
| 5,613,557 | A | 3/1997 | Blount et al. | 166/277 |
| 5,785,120 | A | 7/1998 | Smalley et al. | 166/55 |
| 6,478,091 | B1 * | 11/2002 | Gano | 166/373 |
| 6,561,271 | B1 * | 5/2003 | Baugh et al. | 166/285 |
| 6,598,677 | B1 * | 7/2003 | Baugh et al. | 166/285 |
| 6,631,765 | B1 * | 10/2003 | Baugh et al. | 166/285 |
| 6,648,076 | B1 * | 11/2003 | Broome | 166/386 |
| 6,725,918 | B1 * | 4/2004 | Gano | 166/206 |
| 6,725,934 | B1 * | 4/2004 | Coronado et al. | 166/313 |
| 6,799,635 | B1 * | 10/2004 | Schultz et al. | 166/285 |
| 6,854,522 | B1 * | 2/2005 | Brezinski et al. | 166/387 |
| 6,915,852 | B1 * | 7/2005 | Baugh et al. | 166/285 |
| 2002/0079101 | A1 * | 6/2002 | Baugh et al. | 166/285 |

FOREIGN PATENT DOCUMENTS

GB 2 366 581 A 3/2002

* cited by examiner

*Primary Examiner*—David Bagnell
*Assistant Examiner*—Shane Bomar
(74) *Attorney, Agent, or Firm*—Michael W. Piper

(57) ABSTRACT

A ported expandable tubing having an outer valve sleeve which closes the ports upon tubing expansion. An elastomeric sealing member may be carried between the tubing and the valve sleeve to improve closing of the ports. The elastomeric sealing member may be shaped and positioned to operate as a check valve before tubing expansion. Various fluids may be flowed from the ported tubing into a borehole, or from the borehole into the ported tubing, before tubing expansion. After expansion, the ports are closed by residual clamping forces between the sleeve and tubing. By applying sufficient internal pressure to overcome the clamping forces, fluids can be flowed from the tubing into the borehole after expansion.

35 Claims, 7 Drawing Sheets

EXPANDABLE TUBULAR WITH PORT VALVE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

Field of the Invention

This invention relates to expandable tubular members for use in a borehole, and more particularly to an expandable tubular member with a port and a valve for controlling flow through the port.

It is now common to use open hole completions in oil and gas wells. In these wells, standard casing is cemented only into upper portions of the well, but not through the producing zones. Tubing may then be run from the bottom of the cased portion of the well down to and through the various production zones.

In open hole completions, various steps are usually taken to prevent collapse of the borehole wall or flow of sand from the formation into the production tubing. Use of gravel packing and sand screens are common ways of protecting against collapse and sand flow. More modem techniques include the use of expandable solid or perforated tubing an/or expandable screens. These types of tubular elements may be run into uncased boreholes and expanded after they are in position. Expansion may be by application of an internal force by, for example, a hydraulically inflatable bladder, a packer, a mechanical force applied in short sections, an expansion cone pushed or pulled through the tubular members, etc. The expanded tubing and screens desirably provide a larger internal diameter for fluid flow, provide mechanical support to the borehole wall and restrict or prevent annular flow of fluids outside the production tubing.

It is also common during well completions to pump various materials down production tubing and into the annulus between the tubing and the borehole wall and/or into the formation surrounding the borehole. For example, gravel packing is performed by pumping an aggregate material, e.g. gravel, in a carrier fluid down a tubing and through a port in the tubing, or an open lower end of the tubing, into the annulus between the tubing and the borehole wall. Various materials, e.g. chemicals, cement, epoxy, etc., may be pumped down the tubing, through a port and into the formation. These materials may act as water blocks, may help consolidate the formation to reduce flow of sand into the production tubing, etc.

SUMMARY OF THE INVENTION

The present invention provides an expandable tubing system having a port for flowing materials between the inside of the tubing and the space surrounding the tubing.

The system includes an outer valve sleeve which closes, at least partially, the port when the tubing is expanded.

In some embodiments, the expandable tubing and valve sleeve materials are selected to operate as a check valve after expansion, allowing further flow of materials from the inside to the outside of the tubing, but preventing flow from the outside to the inside of the tubing.

In another embodiment, an elastomeric seal is provided between the valve sleeve and the tubing to improve sealing of the port after tubing expansion.

In some embodiments, the elastomeric seal may be positioned and shaped to function as a check valve, allowing flow only into or out of the tubing, before expansion of the tubing.

In some embodiments, the elastomeric seal may be positioned and shaped to function as a check valve after tubing expansion.

DETAILED DESCRIPTION OF THE INVENTION

The term "check valve" as used herein has its normal meaning of a device, or combination of elements, which operates to allow flow of a material through a flow path in one direction, but resists flow is the opposite direction. The terms "elastomeric" and "elastomer" as used herein have their normal meaning of any of various elastic substances resembling rubber, and includes rubber and similar materials used to form fluid tight seals between metallic parts. The term "expandable tubing" means any of the known tubular elements designed to be installed in a well bore and then expanded while in the bore hole to act as a flow path for injected or produced fluids in normal operation of the well. Expandable tubing includes solid tubing, slotted tubing, perforated tubing and expandable screen elements. The terms "up", "down", "above" or "below" and the like are intended to refer to the normal positions of borehole tools and equipment in a vertical borehole. For slanted or horizontal boreholes, the terms "up" and "above" refer to the direction toward the surface location of the borehole. These directional terms are not meant to be limiting, since most borehole tools or methods may be positioned or practiced in either direction in a borehole.

Figure 1:
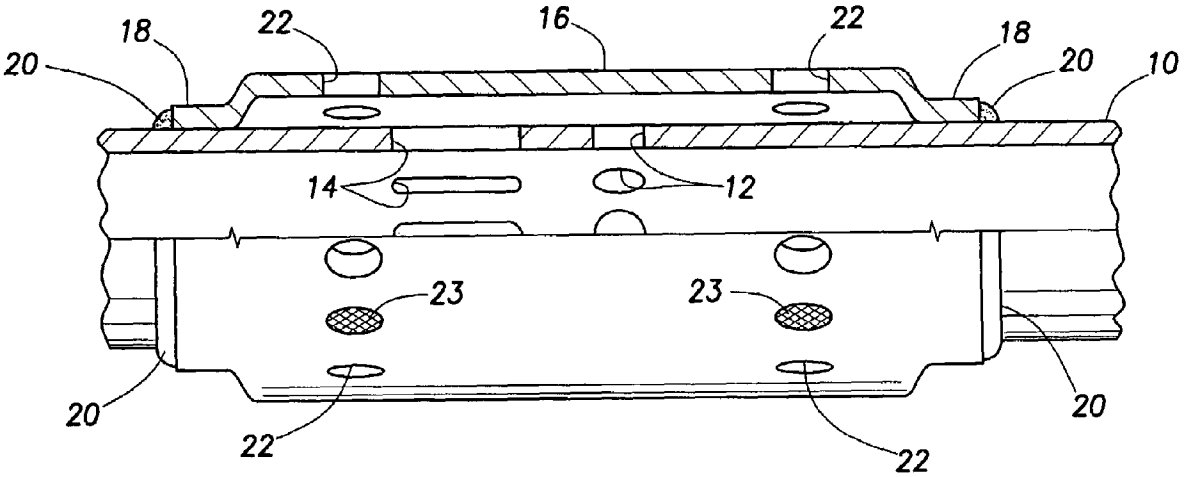
FIG. 1 is a partially cross sectional view of a section of expandable tubing having ports and an outer valve sleeve according to the present invention.

With reference now to FIG. 1, a first embodiment of the present invention will be described. A length of expandable tubing 10 is shown with ports 12 and 14. As illustrated, ports 12 are generally round and ports 14 are elongated or slot shaped. Other port shapes may be used if desired. The alternative slot shapes are shown only to indicate that many different port shapes may be used in the present invention and not to indicate that multiple shapes are needed in any embodiment. The ports 12, 14 provide flow paths between the inside and outside of tubing 10.

An external valve sleeve 16 is carried on the outer surface of tubing 10 at the location of the tubing ports 12, 14. Over most of its length, the sleeve 16 has an inner diameter larger than the outer diameter of tubing 10 by a sufficient amount to provide an annular flow path between tubing 10 and sleeve 16. Each end 18 of the sleeve 16 has a reduced inner diameter about equal to the outer diameter of tubing 10. One or both ends 18 may be attached to the tubing 10 by, for example, welds 20 or by crimping, etc. A number of sleeve ports 22 provide flow paths between the inner and outer surfaces of the sleeve 16. The sleeve ports 22 may be axially displaced from the tubing ports 12, 14, as illustrated, or may be radially displaced as illustrated in other embodiments below.

With further reference to FIG. 1, it can be seen that a continuous flow path between the inside of tubing 10 and the space surrounding the tubing 10 is formed by the combination of the tubing ports 12, 14, the annulus between tubing 10 and valve sleeve 16 and the sleeve ports 22. Thus, when the tubing section 10 is installed in a borehole, fluids may be pumped down the tubing 10, through the ports 12, 14, 22 and into the borehole. Likewise, fluids in the borehole may be produced by flowing through ports 22, 12, 14 and up the tubing 10. This flow path allows various conventional completion processes, chemical treatments, etc. to be performed through the expandable tubing 10, before the tubing 10 is expanded.

The ports 12, 14 and 22 are shown as relatively large openings which would allow flow of many types of fluids and particulate materials carried in such fluids. However, the ports may be in the form of very small openings which would allow fluids to flow, but would block or filter out particulates. For example, the ports may be replaced with sections of screens 23, preferably expandable. These may be useful when the various embodiments are used to produce fluids from a well or when they are used as a return flow path in a gravel packing operation.

Figure 2:
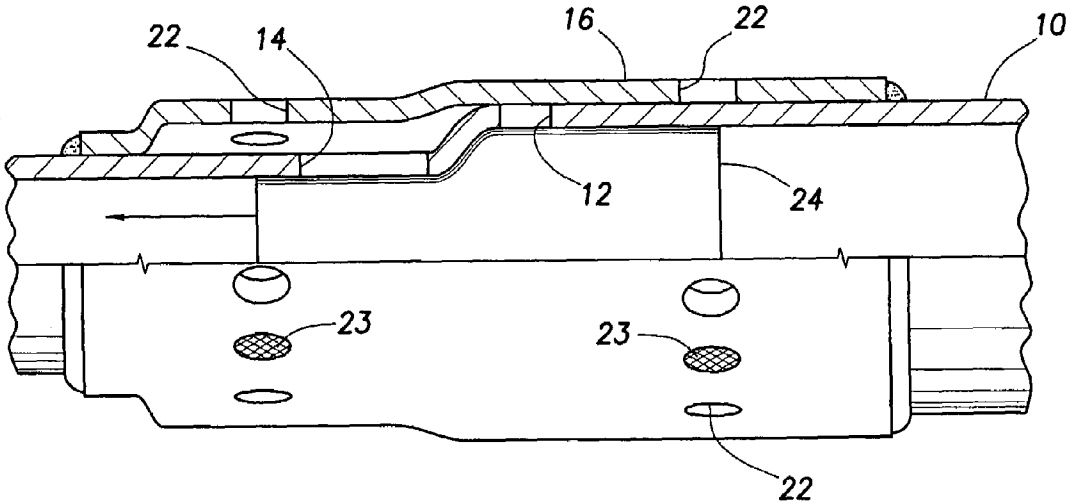
FIG. 2 is a partially cross sectional view of the FIG. 1 embodiment after the tubing has been partially expanded.

With reference to FIG. 2, the tubing section 10 of FIG. 1 is shown in a partially expanded condition. A cone type expansion device 24 is shown passing through the tubing section 10 from right to left, which may be either up hole or down hole. In the right half of FIG. 2, the tubing 10 and valve sleeve 16 have been expanded to final diameter. The expanded outer diameter of tubing 10 is greater than the unexpanded inner diameter of sleeve 16. As a result, the outer surface of tubing 10 has been forced into contact with sleeve 16 and sleeve 16 has also been expanded. The ports 22 on the right side of sleeve 16 have been closed by contact with the tubing 10. The tubing ports 12 have likewise been closed by contact with the sleeve 16. It can be seen that when the expansion cone 24 has moved completely through the tubing section 10, all of the ports 12, 14 and 22 will be closed.

As is well known in the expandable tubing art, expandable tubing 10 springs back from its maximum expanded diameter to a somewhat smaller diameter after the expansion cone 24 passes through the tubing 10. Likewise, the expandable sleeve 16 will spring back to a smaller dimension after expansion. By proper selection of materials, the sleeve 16 is designed to spring back more than the tubing 10. This leaves a residual clamping force between the sleeve 16 and the tubing 10 which helps seal the ports 12, 14, 22 closed.

After the ports 12, 14, 22 have been sealed by tubing expansion as described above, the expanded tubing 10 and sleeve 16 can operate as a check valve. If pressure external to tubing 10 exceeds internal pressure, the sealing force between sleeve 16 and tubing 10 is increased, further blocking flow of borehole fluids into the tubing 10. However, if it is desired to pump fluids from the tubing 10 into the borehole, the fluid may be pumped at a pressure sufficient to overcome the residual clamping force and expand sleeve 16 enough to allow fluids to flow from the tubing 10 into the surrounding borehole. The valve sleeve 16 can be designed, e.g. by selecting material type and thickness, to have a desired relief pressure after expansion. The valve action may be either elastic or plastic depending on material selection, flow area, flow rate, flow pressure and valve design. This will allow selective annulus injection of chemicals, etc. after tubing expansion.

Figure 3:
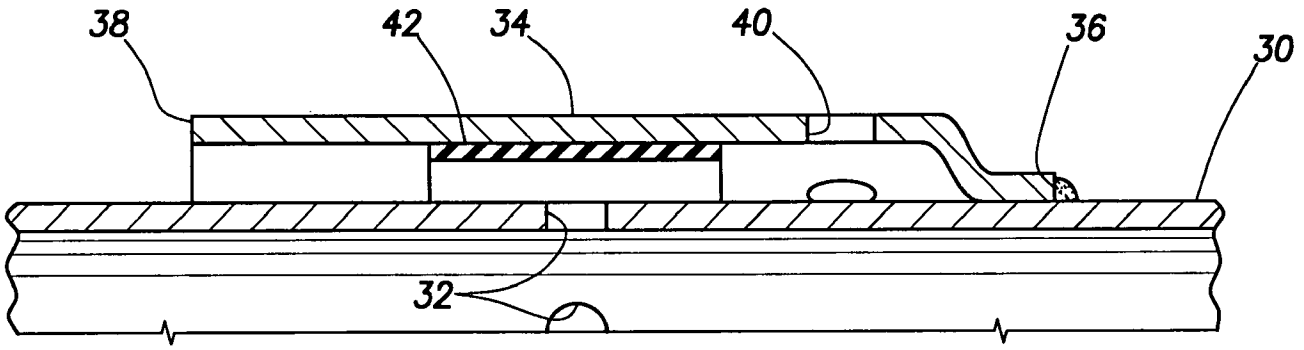
FIG. 3 is a cross sectional view of another embodiment of the present invention including an elastomeric seal sleeve carried on an outer valve sleeve.

With reference to FIG. 3, a partial cross sectional view of another embodiment of the invention is provided. A section of expandable tubing 30 has ports 32. An external valve sleeve 34 is attached at one end 36 to the tubing 30. A second end 38 of sleeve 34 is open. If desired, sleeve ports 40 may be provided near the end 36. An elastomeric sleeve 42 is carried on the inner surface of valve sleeve 34 at the axial location of the tubing ports 32. The tubing ports 32, the annular space between the tubing 30 and the combination of valve sleeve 34 and elastomeric sleeve 42, and the combination of sleeve ports 40 and the open end 38 provide a flow path between the interior and exterior of tubing 30.

Figure 4:
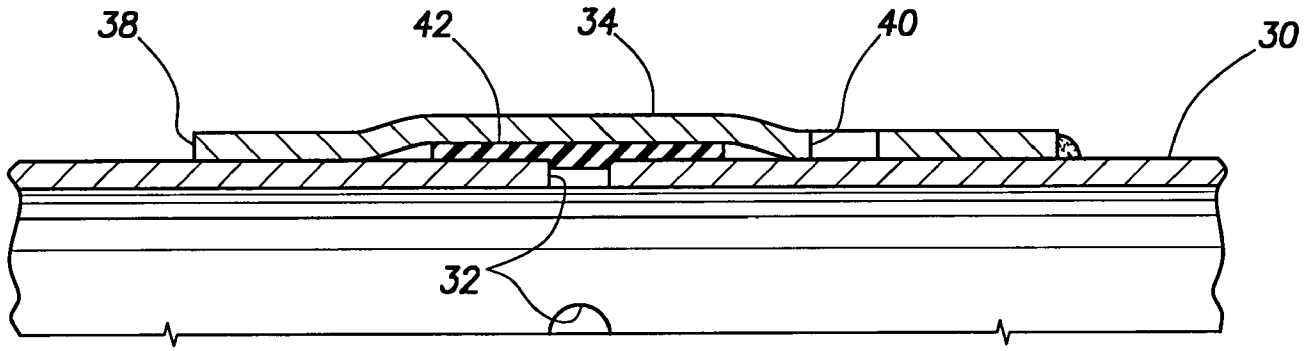
FIG. 4 is a cross sectional view of the FIG. 3 embodiment after expansion.

FIG. 4 illustrates the condition of the FIG. 3 embodiment after expansion of tubing 30. As in the FIG. 1 embodiment, the unexpanded inner diameter of valve sleeve 34 is smaller than the expanded outer diameter of tubing 30. After expansion, both ends 36 and 38 of the valve sleeve 34 may be in a press fit contact with the outer surface of tubing 30. The center of sleeve 34 may be expanded further by the elastomeric sealing sleeve 42. As illustrated, the sealing sleeve 42 will extrude to some extent into the ports 32. This arrangement provides an improved fluid tight seal for the ports 32. However, it is still possible by application of sufficient internal pressure to flow fluids from the tubing into the borehole for later well treatments.

Figure 5:
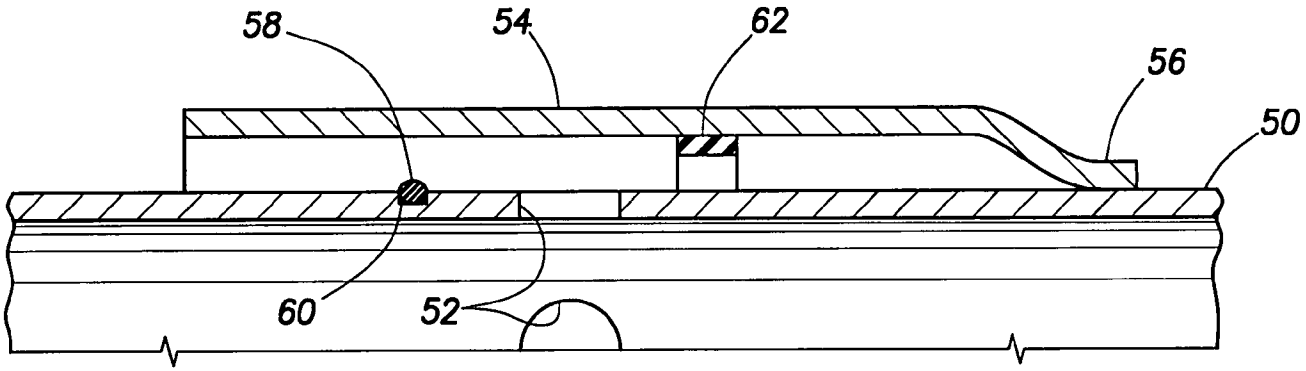
FIG. 5 is a cross sectional view of another embodiment of the present invention illustrating alternative seal rings carried between a valve sleeve and an expandable tubing.

FIG. 5 illustrates several alternative embodiments of the present invention. A section of expandable tubing 50 has a plurality of ports 52. An expandable sleeve 54 is attached at one end 56 to the tubing 50. Two alternative sealing rings are shown axially displace from the ports 52. An O-ring type seal 58 is shown carried in a groove 60 cut into the outer surface of tubing 50. A rectangular cross section sealing ring 62 is illustrated carried on the inner surface of the valve sleeve 54. The seals 58 and 62 may be made of an elastomeric material or a metallic material. It can be seen that upon expansion of the tubing 50 into contact with the valve sleeve 54, both of these seals 58, 62 will form an annular seal stopping flow through the port 52. While the seal ring 62 may not be required unless sleeve ports are provided near end 56, it would provide backup protection, e.g. if a weld attaching sleeve end 56 to the tubing 50 should fracture during expansion. It is apparent that other seal shapes and materials such as metals are possible.

Figure 6:
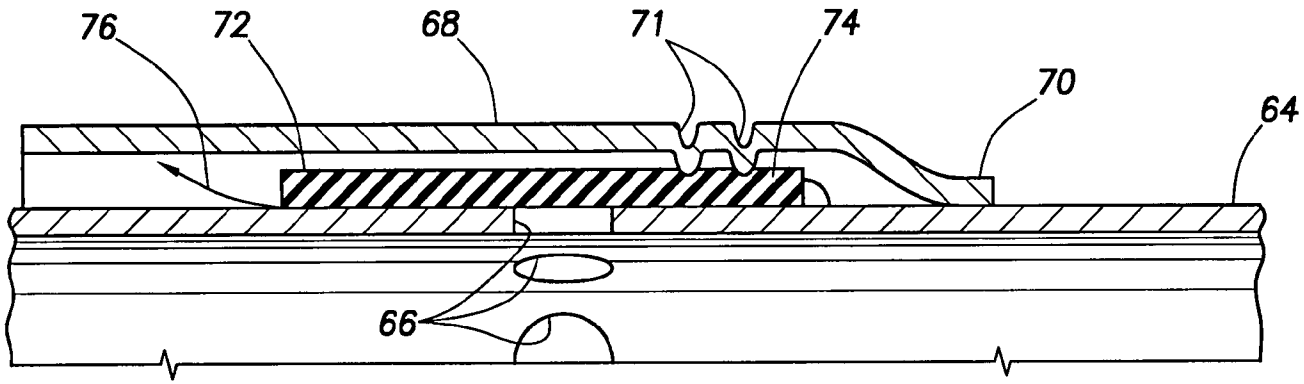
FIG. 6 is a cross sectional view of another embodiment having an elastomeric seal sleeve carried on an expandable tubing section and acting as a check valve before tubing expansion.
Figure 7:
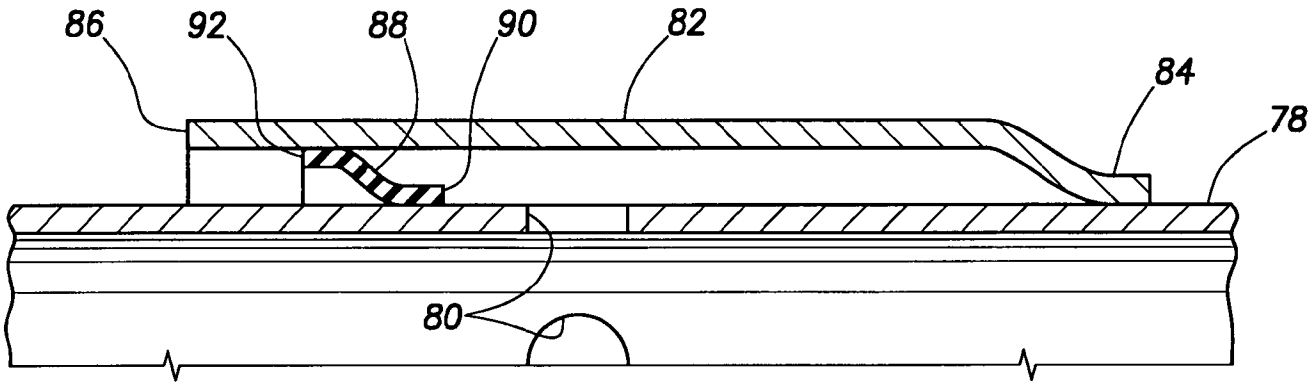
FIG. 7 is a cross sectional view of another embodiment having an elastomeric sealing ring operating as a check valve before tubing expansion.

FIGS. 6 and 7 illustrate embodiments which provide check valve functions before tubing expansion. In FIG. 6, an expandable tubing section 64 has a number of ports 66. A valve sleeve 68 positioned around the ports 66 has one end 70 attached to the tubing 64. An elastomeric sleeve 72 is carried on the outer surface of tubing 64 with one end 74 bonded to the tubing 64. Bonding may be with adhesives or by crimps 71 in the valve sleeve 68 or both. The sleeve 72 has an unstretched inner diameter smaller than the unexpanded outer diameter of the tubing 64. As a result, it must be stretched radially to fit onto the tubing section 64 and provides a tight fit. This tight fit of elastomeric sleeve 72 over the ports 66 provides a check valve function before expansion which allows flow of materials out of tubing 64 through ports 66 and under the elastomeric sleeve as indicated by the arrow 76, but resists flow in the opposite direction. After expansion of the tubing 64, the FIG. 6 embodiment may be essentially identical to the configuration shown in FIG. 4.

The elastomeric sleeve 72 of the FIG. 6 embodiment may be specifically designed to improve sealing, before and after expansion, and to control relief pressure before and after expansion. This may be done by selecting the types of material and its thickness as well as by profiling its shape, for example by tapering or by including ridges or grooves.

In FIG. 7, an expandable tubing section 78 has ports 80. A valve sleeve 82 is positioned around the ports 80 and has one end 84 attached to the tubing 78 and a second end 86 open. An elastomeric sealing ring 88 has one end 90 bonded to the outer surface of tubing 78. The opposite end 92 of the ring 88 is larger than the end 90 like a cup seal. The end 92 has an uncompressed outer diameter larger than the unexpanded inner diameter of valve sleeve 82. The seal ring 88 is positioned between the tubing ports 80 and the open end 86 of the valve sleeve 82. Before tubing expansion, the seal ring 88 therefore acts as a check valve allowing fluid to be flowed though ports 80 past the seal ring 88 and out the open end 86 of the valve sleeve 82. If pressure outside tubing 78 is greater than its internal pressure, the seal ring 88 expands into sealing contact with the valve sleeve 82 and blocks the flow of well bore fluids into the tubing 78.

When the tubing 78 of FIG. 7 is expanded, the ports 80 will be sealed by contact with the valve sleeve 82 in the same way as illustrated in FIGS. 1 and 2. In addition, the seal ring 88 will be compressed between the tubing 78 and the valve sleeve 82 to form a further seal. As described above, after expansion of the FIG. 7 embodiment, the closed ports 80 can still operate as a check valve if sufficient pressure is applied. This pressure will normally be greater than the pressure required to flow fluids past the seal ring 88 before tubing expansion.

Figure 8:
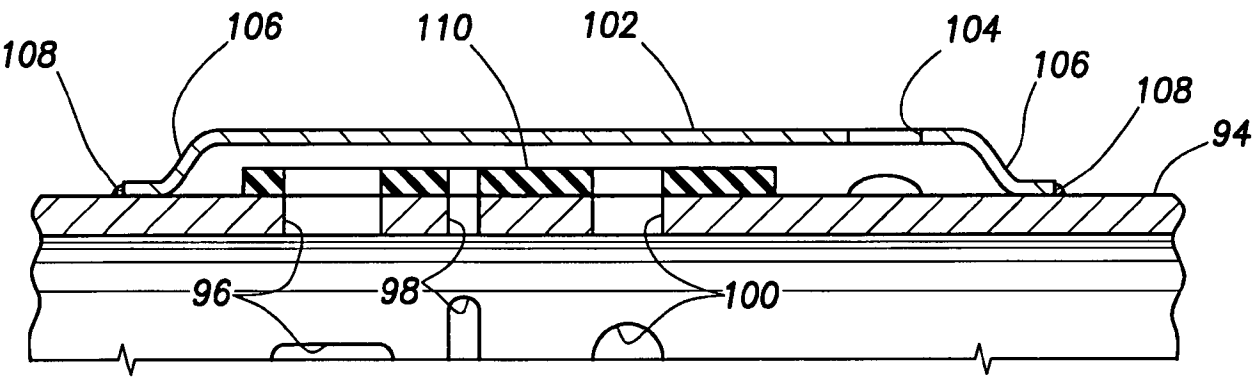
FIG. 8 is a cross sectional view of another embodiment having an elastomeric sealing sleeve carried on an expandable tubing section.

FIG. 8 illustrates another embodiment which may have a molded-in-place elastomeric seal. In FIG. 8, a section of expandable tubing 94 has a number of ports 96, 98 and 100 of various shapes. Various port shapes are shown as alternatives and not to indicate that multiple rows of ports are needed or that multiple shapes are needed. A valve sleeve 102 is positioned around the ports 96, 98, 100. The sleeve 102 has a number of ports 104 and is attached at both ends 106 to the tubing 94, for example by welds 108. An elastomeric sleeve 110 is bonded to the outer surface of tubing 94. The sleeve 110 may be a preformed sleeve having holes matching the ports 96, 98, 100 and may be bonded in the proper position by an adhesive. Alternatively, the sleeve 110 may be formed in place on the surface of tubing 94 by known methods such as mandrel wrapping or molding from a mixture of liquid materials which set into an elastomer bonded to the tubing 94. After the sleeve is formed on the tubing 94, the ports 96, 98 or 100 may be formed by drilling through the sleeve 110 and the tubing 94 in the same operation. This will insure alignment of the holes in the sleeve 110 with the ports 96, 98, 100. Upon expansion of tubing 94, the sleeve 110 will provide a good seal surrounding each of the ports 96, 98, 100.

In the FIG. 8 embodiment, tubing ports and valve sleeve ports could be at the same axial location, so long as they are radially displaced. For example, two of the round tubing ports 100 could be provided at degree radial locations, i.e. on opposite sides of the tubing 94. Two round valve sleeve ports 104 could be located at the same axial location, but with 90 degree offsets from the tubing ports. Upon expansion of the tubing 94, portions of the elastomeric sleeve 110 between the tubing ports 100 would cover and expand into the valve sleeve ports 104 and seal them. This arrangement would be applicable to the other embodiments described herein also.

In FIG. 8, the length of elastomeric sleeve 110 may be increased so that it is aligned with the valve sleeve 102 ports 104. Upon expansion of the tubing 94, the extended elastomeric sleeve 110 would seal the valve sleeve ports 104 in the same manner as the tubing ports 32 are sealed by sealing sleeve 42 in FIG. 4.

Figure 9:
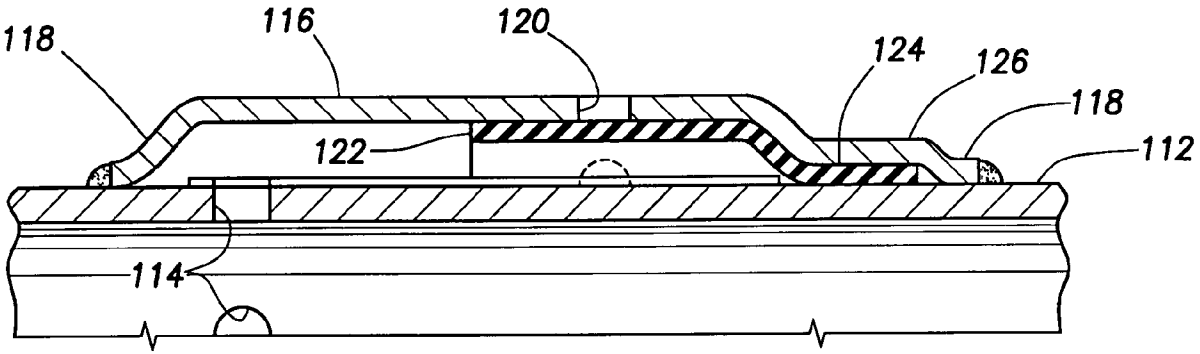
FIG. 9 is a cross sectional view of another embodiment of the present invention including an elastomeric seal sleeve carried on an outer valve sleeve and acting as a check valve both before and after tubing expansion.
Figure 10:
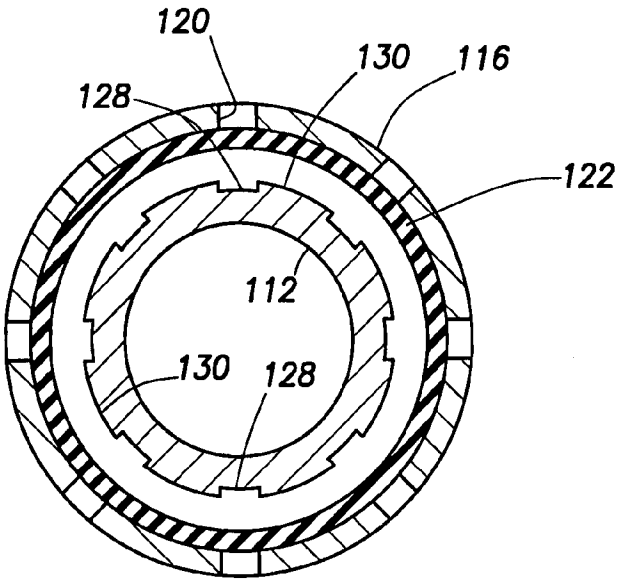
FIG. 10 is a sectional view of the embodiment of FIG. 9 illustrating a tubing external profile which allows the elastomeric sleeve to function as a check valve after expansion.

FIGS. 9 and 10 illustrate another embodiment in which an elastomeric sleeve may be used as a check valve allowing flow into a tubing before expansion. FIG. 9 is a partial longitudinal cross section and FIG. 10 is an axial cross section of this embodiment. An expandable tubing 112 has a number of ports 114. A valve sleeve 116 surrounds the ports 114 and is attached to the tubing 112 at both of its ends 118. Sleeve 116 has a number of ports 120. An elastomeric sleeve 122, having an unconstrained outer diameter greater than the unexpanded inner diameter of valve sleeve 116, is positioned against the inner surface of sleeve 116 at the location of ports 120. The sleeve 122 may be held in place by having one end 124 bonded, e.g. by adhesive, to the tubing 112 and/or the sleeve 116 and/or by being crimped under a reduced diameter portion 126 of the valve sleeve 116.

With the configuration as shown in FIG. 9, it can be seen that the rubber sleeve 122 acts as a check valve. It blocks the flow of fluid from the tubing 112 through ports 114 and out the valve sleeve ports 120. However, it allows fluid to flow in the reverse path, i.e. through ports 120 to the ports 114 and into the tubing 112. Upon expansion of the tubing 112, the sleeve 122 will be compressed between the tubing 112 and the sleeve 116 and may block flow of fluids in either direction through the ports 114 and 120.

In FIG. 10, there is illustrated a feature which may allow the FIG. 9 embodiment to act as a check valve after expansion. The outer diameter of the tubing 112 has been machined or otherwise provided with an irregular outer diameter. The outer diameter of tubing 112 is less in areas 128 which are positioned in radial alignment with the valve sleeve ports 120 and the tubing ports 114 than it is in areas 130 which are positioned between the ports 120. The areas 128 thus provide reduced diameter longitudinal grooves under the elastomeric sleeve 122 running from the valve sleeve ports 120 to the tubing ports 114. Upon expansion of the tubing 112, the larger diameter areas 130 will contact the sleeve 122 and cause the valve sleeve 116 to expand. With proper dimensions and materials, the reduced diameter portions 128 will not contact the elastomeric sleeve 122. Upon application of a sufficiently large outside pressure through the ports 120, the sleeve 122 will be free to deflect into the reduced diameter portions 128 and provide a fluid flow path to the ports 114. Flow will still be blocked from the tubing 112 to the ports 120.

Figure 12:
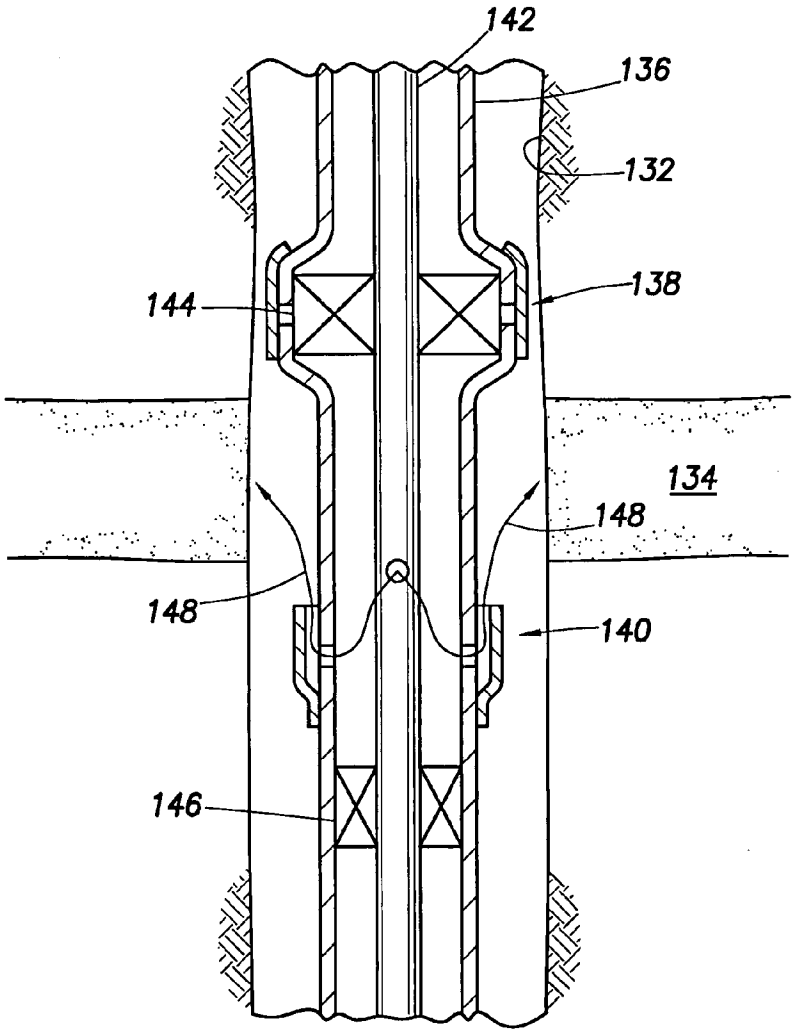
FIG. 12 is a cross sectional view of the FIG. 11 embodiment after partial expansion of the expandable tubing illustrating use of the present invention in another step of completing a well.
Figure 11:
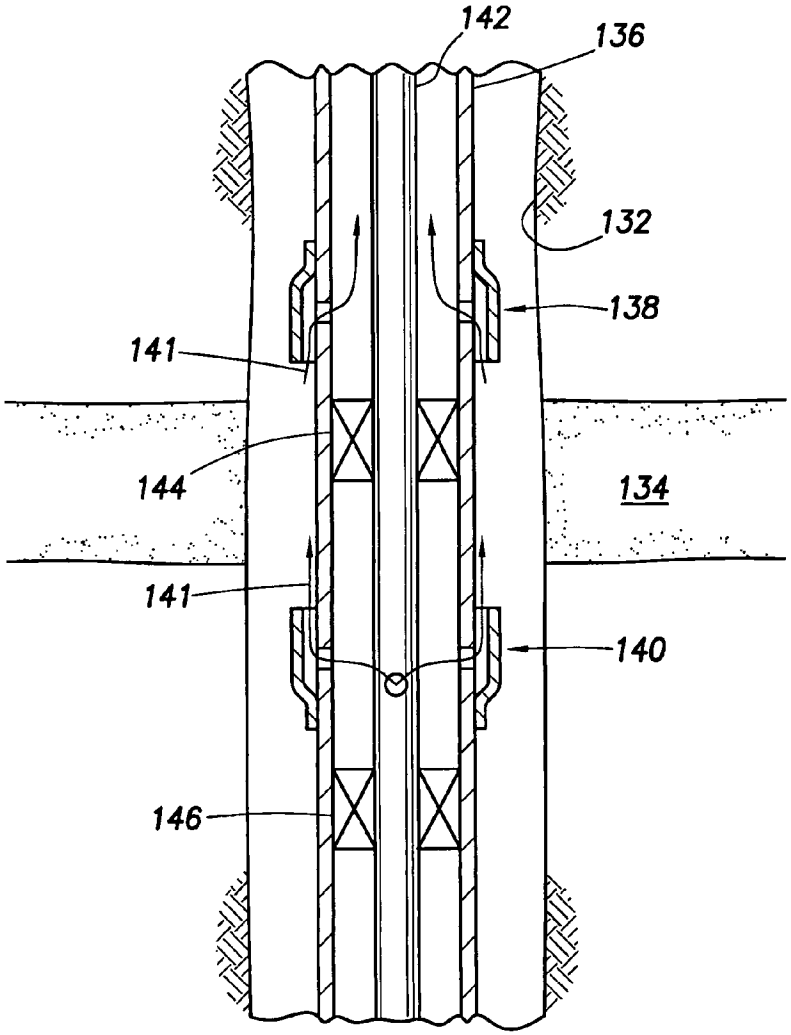
FIG. 11 is a cross sectional view of an expandable tubing string in a well bore illustrating use of the present invention in one step of completing a well.

FIGS. 11 and 12 illustrate a typical use of the present invention. In these figures, an open borehole 132 has been drilled through earth formations including a producing zone 134. A string of expandable tubing 136 has been lowered into the borehole 132 as part of a completion process. Before expansion of the tubing string 136, it is desired to pump a treatment fluid at least into the producing formation 134. Included in the string 136 are an upper ported section 138 above formation 134 and a lower ported section 140 located below formation 134. Section 140 may have a preexpansion check valve arrangement as shown in FIG. 6 or 7. Section 138 may be an embodiment as shown in FIGS. 1, 3, or 5 which allows flow from the borehole into the tubing string 136 and may have a pre-expansion check valve arrangement as shown in FIG. 9. Section 138 may include a screen portion in its valve sleeve instead of larger ports, e.g. if it is desired to place a gravel pack between tubing 136 and the wall of borehole 132.

In this example, it is desired to remove all drilling fluid from the annulus between tubing string 136 and the production zone 134 before injecting treating fluids. The drilling fluids may interfere with injection and/or damage the formation 134 if injected. A tubing or work string, such as coiled tubing, 142 having a pair of inflatable packers 144 and 146 has been lowered into the tubing 136 so that the packer 144 is located between the ported sections 138 and 140 and the packer 146 is located below section 140. The packers 144, 146 have been set, by inflation or other means, to seal the annulus between the coiled tubing 142 and the expandable tubing 136. As indicated by the arrows 141 in FIG. 11, fluid is flowed down coiled tubing 142 into the expandable tubing 136 between packers 144 and 146, then out the ports in section 140, up the annulus between expandable tubing 136 and the borehole 132, through ports in section 138 back into the tubing 136 and then back to the surface. This flow allows removal of drilling fluid adjacent the production zone 134.

After flushing the drilling fluid out from zone 134, the packers 144 and 146 may be released or unset and moved so that packer 144 is located in section 138 as illustrated in FIG. 12. It is then inflated with sufficient force to expand the tubing 136 close to or into contact with the borehole 132 to form at least a partial seal. In this application, it may be desirable to attach an elastomeric ring or sleeve to the outer surface of the valve sleeve used in section 138 to increase the likelihood of closing the annulus. Other means of blocking the annulus are also available, e.g. placement of chemicals in the annulus. A treatment fluid may then be pumped down the coiled tubing 142, into tubing 136 between packers 144, 146, out the ports in section 140, and into the formation 134 as indicated by arrows 148. Since inflation of the packer 144 expanded the section 138, the ports in section 138 are sealed and do not allow return flow up the tubing 136. Likewise expansion of the section 138 stops or restricts flow up the annulus between the tubing 136 and the borehole 132. It may also be desirable to also close off the various return flow paths at the wellhead to force treatment fluids to flow into the formation 134. This allows sufficient pressure to be applied to pump treatment fluid into the formation 134. After this treatment is completed, the coiled tubing string 142 may be removed. If desired, the coiled tubing string 142 may be used to pull an expansion cone up through the expandable tubing string 136 as it is removed so that the entire string is expanded to final dimension as the coiled tubing is removed.

Figure 13:
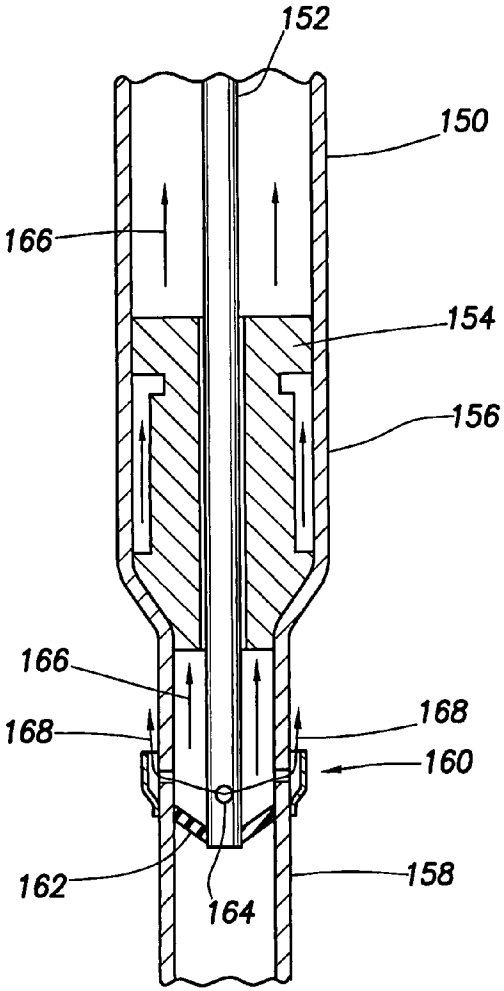
FIG. 13 is a cross sectional view of an expandable tubing string in a well bore illustrating use of the present invention in another well completion process.

FIG. 13 illustrates another application of an expandable valved port according to the present invention. In this application, it is desired to inject a treatment fluid into a borehole during the process of expanding an expandable tubing in the borehole. An expandable tubing 150 is shown in a partially expanded condition. A work string 152 is being used to convey an expansion tool 154 down the tubing 150. An upper portion 156 has been expanded, while a lower portion 158 is in its unexpanded condition. A valved port section 160 is included in the lower portion 158. A cup seal 162 is carried on the lower end of the work string 152. During the normal expansion process, fluids are pumped down the work string 152, flow out a port 164 in the work string, and flow back up between the tubing 150 and the work string 152 as indicated by the arrows 166.

In FIG. 13, the work string 152 has reached a depth at which the cup seal 162 is below the valved port section 160. At this point, fluids pumped down the work string 152 may be flowed through the ported section 160 and outside the tubing 150 for well treatment purposes. Movement of the expansion tool may be stopped at this position while the treatment fluids are pumped into the formation. It may be desirable to close off the return flow paths at the wellhead as a way of building sufficient pressure for injection into the formation and for controlling the timing and total quantity of the treatment. When the treatment has been completed, the expansion process can be continued and the ported section 160 may thereby be sealed to prevent further flow of fluids in or out of the tubing 150 through the ported section 160.

Figure 14:
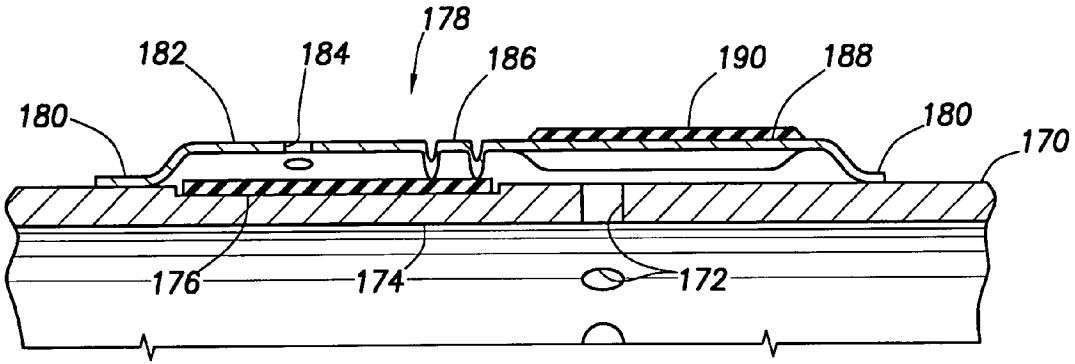
FIG. 14 is a cross sectional view of another embodiment of the present invention including a deployable annular barrier as part of a valve sleeve.
Figure 15:
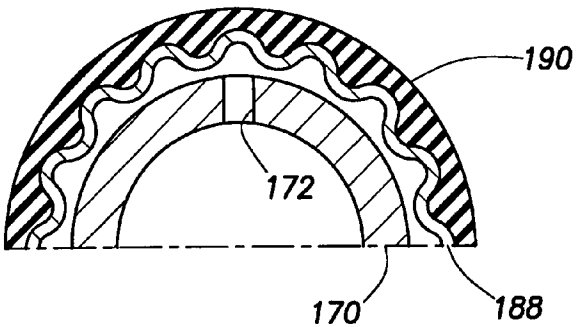
FIG. 15 is a sectional view of the FIG. 14 embodiment, showing more detail of the deployable annular barrier.

FIGS. 14 and 15 illustrate an alternate embodiment which may provide an annular barrier and a check valve allowing injection of fluids into the annulus. A section of expandable tubing 170 has a number of ports 172. A portion 174 of the tubing 170 has a reduced outer diameter. An elastomeric sleeve 176 is carried on the outer surface of the reduced diameter portion 174. A sleeve 178 is carried on the outer surface of tubing 170. The sleeve 178 has two ends 180 having reduced diameters corresponding to the outer diameter of tubing 170. The ends 180 are attached to the tubing 170, for example by welding. A portion 182 of the sleeve 178 has ports 184 positioned around the elastomeric sleeve 176. A center portion 186 of sleeve 178 is crimped into contact with the elastomeric sleeve 178. Another portion 188 of the sleeve 178 is axially corrugated and carries an elastomeric layer 190 on its outer surface. The portion 188 is axially aligned with the ports 172 in expandable tubing 170.

The sleeve 178 portion 182 functions like a port valve in the above described embodiments. That is, the ports 184 provide a flow path to allow materials flowing through tubing 170 and out the ports 172 to flow into the space surrounding the tubing 170, but may be closed by expansion of tubing 170. In this embodiment, the crimps 186 provide a partial blockage of this flow path. A certain amount of pressure must be applied through the ports 172 to expand the sleeve 178 to open a flow path between the crimps 186 and the elastomeric sleeve 176.

The portion 188 of the sleeve 178 functions as a deployable annular barrier which may be used to seal an annulus between the tubing 170 and a borehole in which it may be installed. Since portion 188 is corrugated, it can be expanded by applying internal pressure lower than would be required for a cylinder having the same wall thickness of the same material. The portion 188 may alternatively, or in addition, be annealed or formed from an easily expanded metal, metal alloy, composite or other material. The elastomeric layer 190 is designed to form a fluid seal against a borehole wall when the section 188 is expanded.

The embodiment of FIGS. 14 and 15 may be used to advantage in various borehole operations. For example, it may be used in place of the valved port assembly 140 in FIG. 12. In that application, the FIG. 14 embodiment may be positioned with the sleeve portion 182 above the portion 188. When fluid is to be pumped into the formation 134, the fluid pressure would be increased to a first level sufficient to expand the corrugated section 188, but not sufficient to open the check valve formed by crimped section 186 and the elastomeric sleeve 176. The section 188 would then expand, e.g. by unfolding or straightening the corrugations. The outer elastomeric layer 190 would preferably contact the borehole wall and form a seal blocking annular flow past the portion 188. The pressure in tubing 170 may then be increased to open the check valve, i.e. expand the crimped section 186. Fluid would then flow into sleeve section 182 and out the ports 184. The annular seal would force the fluids to flow in only one direction in the annulus, which in FIG. 12 would be the direction indicated by arrows 148. It may not be necessary in this embodiment to actually apply fluid pressure in two or more distinct steps. That is, the pressure may simply be ramped up and the three functions of expanding the portion 188, opening the crimps 186 and flowing fluids through the outer ports 184 should naturally occur in that order if materials are selected and sized properly.

After injection of fluids using the embodiment of FIGS. 14 and 15, the tubing 170 may be expanded as described in the other embodiments. The expansion will move the elastomeric sleeve 176 into contact with the sleeve 178 section 182 and expand the section 182 to some extent. This expansion will seal the ports 184. The sealed ports 184 may still function as a check valve allowing further injection of fluids if sufficient pressure is applied through the ports 172.

The embodiment of FIG. 14 may be modified by omission of the portion 182 of the sleeve 178 and that part of the elastomeric sleeve 176 which does not lie under the crimped portion 186. The resulting structure may still operate as described above. Upon application of pressure at a first level through the tubing ports 172 the section 190 may inflate and form a barrier in the annulus surrounding the tubing 170. At a higher pressure, the check valve formed by section 186 may open and allow fluid to flow into the annulus. Upon expansion of the tubing 170, the remaining portion of sleeve 176 will be driven into contact with crimped portion 186 with sufficient force to expand the portion 186. The resulting seal will effectively close the ports 172.

While the present invention has been described with reference to uses in open boreholes, it is apparent that the present invention may be used to advantage in cased boreholes also. For example, expandable tubing may be used as a liner to repair damaged casing. In such repairs it may be desirable to inject a chemical treatment or a liquid sealant material before expanding the tubing into contact with the damaged casing. Various embodiments of the present invention may be useful in placing the chemical or sealant between the tubing and casing before expansion of the tubing.

While the present invention has been illustrated and described with reference to particular apparatus and methods of use, it is apparent that various changes can be made thereto within the scope of the present invention as defined by the appended claims.

What we claim as our invention is:

1. Apparatus comprising:

a section of expandable tubing having at least one tubing port, having a first unexpanded outer diameter, and being expandable to a second expanded outer diameter, and a valve sleeve carried on an outer surface of the expandable tubing at the location of the at least one tubing port and having, before expansion of the tubing, an inner diameter greater than the first unexpanded outer diameter and smaller than the second expanded outer diameter, whereby upon expansion of the expandable tubing from the first unexpanded outer diameter to the second expanded outer diameter at the location of the at least one tubing pod, the at least one tubing pod is substantially closed.

2. Apparatus according to claim 1, wherein the valve sleeve comprises metal.

3. Apparatus according to claim 1, wherein a portion of the valve sleeve has an inner diameter about equal to the first diameter, and the valve sleeve portion is coupled to the section of expandable tubing.

4. Apparatus according to claim 3, wherein the valve sleeve portion is welded to the section of expandable tubing.

5. Apparatus according to claim 1, further comprising a seal carried between the section of expandable tubing and the valve sleeve.

6. Apparatus according to claim 5, wherein the seal comprises an elastomeric sleeve carried on an inner surface of the valve sleeve in alignment with the at least one tubing port.

7. Apparatus according to claim 5, wherein the seal comprises a ring carried on an inner surface of the valve sleeve axially displaced from the at least one tubing port.

8. Apparatus according to claim 7, wherein the ring is made of an elastomeric material.

9. Apparatus according to claim 7, wherein the ring is made of a metallic material.

10. Apparatus according to claim 5, wherein the seal comprises a ring carried on an outer surface of the section of expandable tubing axially displaced from the at least one tubing port.

11. Apparatus according to claim 10, wherein the ring is made of an elastomeric material.

12. Apparatus according to claim 10, wherein the ring is made of a metallic material.

13. Apparatus according to claim 5, wherein the seal comprises an elastomeric sleeve carried on an outer surface of the section of expandable tubing in axial alignment with the at least one tubing port.

14. Apparatus according to claim 13, wherein the elastomeric sleeve has an unstretched inner diameter smaller than the first diameter.

15. Apparatus according to claim 14, wherein the elastomeric sleeve has one end coupled to the section of expandable tubing.

16. Apparatus according to claim 5, wherein the seal comprises an elastomeric sleeve carried on an outer surface of the section of expandable tubing axially displaced from the at least one tubing port, the elastomeric sleeve has a first end having an inner diameter about equal to the first diameter and a second end having an outer diameter about equal to the valve sleeve inner diameter.

17. Apparatus according to claim 1, further comprising at least one valve sleeve port through the valve sleeve.

18. Apparatus according to claim 17, further comprising an elastomeric seal carried between the valve sleeve and the tubing.

19. Apparatus according to claim 18, wherein the elastomeric seal is aligned with the at least one valve sleeve port.

20. Apparatus according to claim 19, wherein the elastomeric seal is carried on the inner surface of the valve sleeve.

21. Apparatus according to claim 18, wherein the elastomeric seal is aligned with the at least one tubing port.

22. Apparatus according to claim 1, wherein a portion of the valve sleeve is perforated.

23. Apparatus according to claim 1, wherein a portion of the valve sleeve comprises expandable screen.

24. Apparatus according to claim 1, wherein a portion of the valve sleeve comprises slotted expandable tubing.

25. Apparatus according to claim 1, wherein the valve sleeve comprises a first section defining an annulus between the sleeve first section and the tubing, the annulus being in communication with the at least one tubing port, the first section having first and second ends in sealing contact with the tubing, the sealing contact resisting internal pressure up to a first pressure level, and the sleeve first section comprising material which will expand at a pressure below the first pressure level.

26. Apparatus according to claim 25, further comprising a layer of sealing material carried on the outer surface of the valve sleeve first section.

27. Apparatus according to claim 26, wherein the sealing material is an elastomeric material.

28. Apparatus according to claim 25, wherein the valve sleeve first section comprises corrugated metal.

29. A method of flowing fluids into a borehole, comprising:

installing in a borehole a section of expandable tubing having at least one tubing port from its inner surface to its outer surface and carrying an external sleeve spaced from its outer surface at the location of the at least one tubing port, flowing fluid through the expandable tubing and the at least one port into the borehole, and expanding the tubing into contact with the sleeve.

30. A method according to claim 29, further comprising blocking the flow of fluids from the borehole into the tubing through the at least one tubing port by providing an elastomeric sleeve on the outer surface of the tubing and covering the at least one tubing port.

31. A method according to claim 29, further comprising:

forming a first portion of the external sleeve from a material which expands upon application of a first internal pressure, separating the first portion of the external sleeve from space surrounding the tubing with a relief valve which opens at a second internal pressure greater than the first internal pressure, and flowing fluid through the at least one port at a pressure above the first internal pressure but below the second internal pressure, thereby expanding the first portion of the external sleeve.

32. A method according to claim 31, further comprising flowing fluid through the at least one port at a pressure above the second internal pressure, thereby opening the relief valve.

33. A method according to claim 31, further comprising providing a layer of sealing material on the outer surface of the first portion of the external sleeve, whereby upon expansion of the first portion of the external sleeve, the sealing material forms at least a partial annular barrier in the borehole.

34. A method of flowing fluids from a borehole, comprising:

installing in a borehole a section of expandable tubing having at least one tubing port from its inner surface to its outer surface and carrying a valve sleeve spaced from its outer surface at the location of the at least one tubing port, flowing fluid from the borehole through the at least one tubing port into the expandable tubing, and expanding the tubing into contact with the sleeve.

35. A method according to claim 34, wherein the valve sleeve has first and second ends and at least one valve sleeve port extending from its inner surface to its outer surface, further comprising:

providing fluid tight seals between the first and second ends of the valve sleeve and the expandable tubing, and blocking the flow of fluids from the tubing into the borehole through the at least one tubing port by providing an elastomeric sleeve on the inner surface of the valve sleeve and covering the at least one valve sleeve port.

* * * * *